United States Patent [19]

Bothwell

[11] Patent Number: 4,572,809

[45] Date of Patent: Feb. 25, 1986

[54] CARBURETTOR

[76] Inventor: Peter W. Bothwell, "Meoncotet", 114 Shipston Rd., Stratford upon Avon, Warwickshire, United Kingdom

[21] Appl. No.: 560,195

[22] Filed: Dec. 12, 1983

[30] Foreign Application Priority Data

Dec. 17, 1982 [GB] United Kingdom ..... 8235974

[51] Int. Cl.[4] ..... F02M 17/12

[52] U.S. Cl. ..... 261/44 A; 261/44 E

[58] Field of Search ..... 261/44 A, 44 E

[56] References Cited

U.S. PATENT DOCUMENTS

| | | | |
|---|---|---|---|
| 1,022,702 | 4/1912 | Rothe et al. | 261/41 B |
| 1,155,457 | 10/1915 | Wetterhahn | 261/44 A |
| 1,477,280 | 12/1923 | Pordes | 261/44 A |
| 1,493,894 | 5/1924 | Reece | 261/41 B |
| 1,520,926 | 12/1924 | Brown, Jr. | 261/44 A |
| 1,555,489 | 9/1925 | Spencer et al. | 261/44 H |
| 2,617,638 | 11/1952 | Udale | 261/44 A |
| 2,658,734 | 11/1953 | Henning | 261/65 |
| 2,995,349 | 8/1961 | Kennedy, Sr. et al. | 261/44 A |
| 3,220,709 | 11/1965 | Pickron et al. | 261/44 A |
| 3,266,785 | 8/1966 | Kennedy, Sr. | 261/44 A |
| 3,943,207 | 3/1976 | Harootian | 261/44 A |
| 4,064,847 | 12/1977 | Holzbaur et al. | 261/44 A |
| 4,102,952 | 7/1978 | Snipes | 261/44 A |
| 4,292,257 | 9/1981 | Knowlton | 261/44 A |
| 4,322,376 | 3/1982 | Hammons et al. | 261/44 A |

FOREIGN PATENT DOCUMENTS

| | | | |
|---|---|---|---|
| 611784 | 7/1926 | France | 261/44 A |
| 258338 | 9/1926 | United Kingdom . | |
| 263389 | 12/1926 | United Kingdom . | |
| 280293 | 11/1927 | United Kingdom . | |
| 1367095 | 9/1974 | United Kingdom . | |
| 1508443 | 4/1978 | United Kingdom . | |
| 1547467 | 6/1979 | United Kingdom . | |
| 1554606 | 10/1979 | United Kingdom . | |
| 1556854 | 11/1979 | United Kingdom . | |

*Primary Examiner*—Tim Miles

*Attorney, Agent, or Firm*—Parmelee, Miller, Welsh & Kratz

[57] ABSTRACT

A carburettor has a butterfly valve formed with an internal passage and outlet openings communicating with the passage. Fuel is discharged through the butterfly valve into the air stream to form a combustible mixture.

2 Claims, 16 Drawing Figures

CARBURETTOR

BACKGROUND OF THE INVENTION

This invention relates to a carburettor, by which I mean a device which defines respective inlets for air and fuel and a common outlet for a mixture of the air and fuel, which device causes mixing of the fuel and air when in use. The invention is concerned primarily with carburettors for internal combustion engines.

A pressure differential which causes flow of fuel into the carburettor through the fuel inlet thereof and into a stream of air flowing through the carburettor may be established by a venturi effect on the air stream, by the action of gravity on the fuel, by the action of a pump on the fuel or by a combination of these. In a case where the fuel is caused to flow into the carburettor by a pump, the pump may operate continuously. Alternatively, the pump may operate intermittently to inject into the air stream at a predetermined time a predetermined volume of fuel or to inject fuel into the air stream for a period of predetermined duration.

SUMMARY OF THE INVENTION

The object of the invention is to provided a new or improved carburettor.

According to one aspect of the invention, there is provide a carburettor comprising a valve member which is movable to regulate the flow of air from the air inlet to the outlet, at least one opening being provided in the valve member and communicating with the fuel inlet to discharge fuel into an air stream which flows past the valve member in use.

The term "air" as used herein is intended to include atmospheric air, and any other gas containing oxygen which, when mixed with the fuel, provides an explosive mixture.

The arrangement is preferably such that the restriction of the path along which fuel flows from the fuel inlet to the outlet is varied in accordance with movement of the valve member. With this arrangement, the valve member may be used to regulate both the air flow and the fuel flow. The valve member may act as a valve in the air flow path and in the fuel flow path.

Preferably, the valve member is turnable to regulate the flow of air from the air inlet to the outlet.

In this case, the valve member preferably comprises an element of generally plate-like form which is turnable about an axis transverse to the longitudinal axis of a passageway through which air flows from the air inlet to the outlet to vary the effective cross-sectional area of the passageway and hence the air flow through it. The passageway may be of substantially cylindrical form and the valve member may be in the form of a disc or butterfly valve.

The valve member preferably has a plurality of said openings.

The openings may be distributed over part of or the entire surface of the valve member. They may be arranged to direct fuel into the air flow upstream and/or downstream of the valve member or upstream and/or downstream of the position occupied by the valve member when it restricts the air flow to a maximum degree.

Preferably, as the valve member is turned to increase or reduce the air flow to the outlet, the rate at which fuel is introduced into the air flow through the opening or openings in the valve member is automatically increased or decreased, respectively, thereby maintaining an appropriate fuel/air mixture.

This may be achieved by providing the valve member with a hollow part and with an inner element disposed within the hollow part and movable relative to the valve member to open or cover one or more apertures which form part of the fuel flow path from the fuel inlet to the outlet. The inner element may be fixed with respect to a body of the carburettor, the valve member turning on the inner element. Alternatively, the inner element may be movable along the hollow part of the valve member as the valve member turns.

The apertures may be arranged in various configurations. In one example, the hollow part of the valve member and a fixed inner feed pipe each has along its length a plurality of apertures arranged so that turning of the hollow part varies the number of apertures brought into registration or/and varies the degree of registration of the apertures. In another example, the hollow part has a circumferentially extending series of apertures and the feed pipe has a single aperture in the end thereof inside the hollow part, this end of the feed pipe being formed so that on turning of the pipe it closes a varying number of the apertures in the hollow part.

In a preferred embodiment, side faces of the valve member are shaped aerodynamically, so that there is a reduction in air pressure adjacent one or both of the faces which assists the flow of fuel from the openings into the air stream. For example, both faces may be convex or one side face may be convex and the other concave.

There is also provided according to the invention an internal combustion engine having a carburettor according to the first aspect of the invention in combination with a poppet valve for controlling flow of mixture from the carburettor through said outlet and means for guiding the poppet valve for reciprocation along a rectilinear path inclined to a main axis of the carburettor, wherein the plane containing the main axis of the carburettor and an axis about which the valve member moves is inclined at an acute angle to the plane containing the main axis of the carburettor and a longitudinal centreline of the path along which the poppet valve is guided.

According to a further aspect of the invention, there is provided a method of mixing a fluid fuel with air wherein the restriction of a path along which the air flows and the restriction of a path along which the fuel flows are both varied by movement of a single valve member.

DETAILED DESCRIPTION

Figure 1:
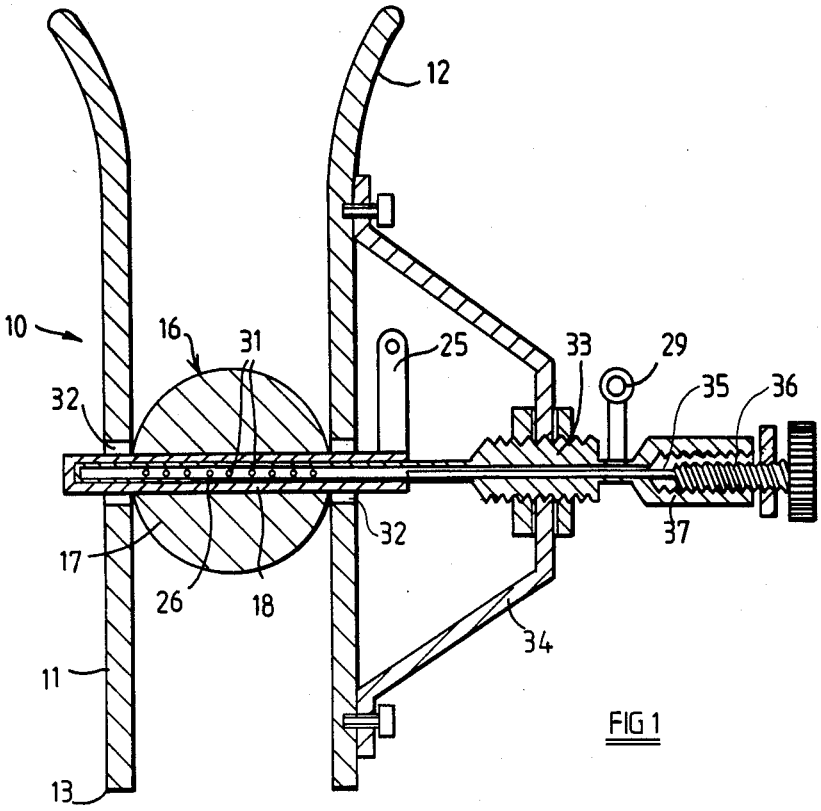
FIG. 1 is a front view, partly in section, of one form of carburettor according to the invention.

Referring to FIG. 1, there is shown a carburettor 10 comprising an elongate cylindrical tube 11 having a flared open end 12 providing an air inlet and a plain open end 13 providing an outlet through which, in use, an air/fuel mixture passes to one or more combustion chambers of an internal combustion engine. The tube 11 provides a passageway containing a butterfly valve 16.

The valve 16 comprises a valve member 17 in the form of a disc having a diametral sleeve 18 extending through it and mounted for turning on a fuel feed pipe 26 extending transversely of the longitudinal axis of the passageway. The valve member is turnable by a radially extending lever 25 attached to the valve member and connected via a cable or rigid link, or any other means, to a control such as an accelerator pedal (not shown).

Alternatively, the valve member 17 may be formed of a single piece of material into which fuel passages are drilled and which is keyed on the fuel feed pipe 26.

Figure 2:
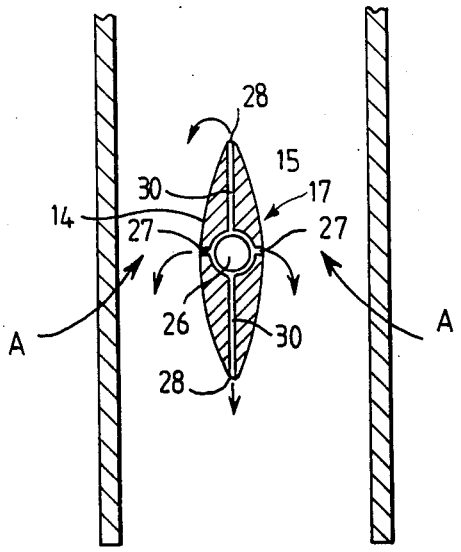
FIG. 2 is a side view, also partly in section, corresponding to FIG. 1.
Figure 3:
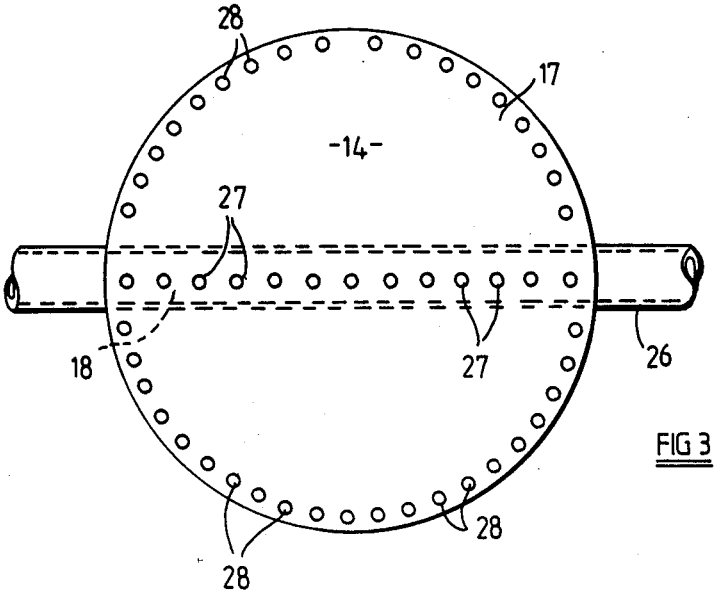
FIG. 3 is a detailed plan view of a valve member of the carburettor.
Figure 4:
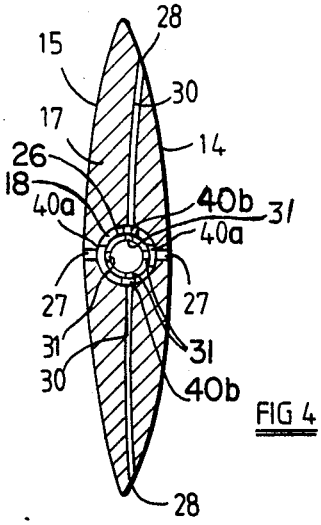
FIG. 4 is a section through the valve member.

As shown in FIG. 2, the side faces 14, 15 of the valve member 17 are each of convex form.

The valve member 17 is turned to vary the restriction of the air flow path to regulate the air flow from the air inlet 12 to the outlet 13 by varying the effective cross-sectional area of the passageway. When the valve member is in its fully closed position, air flow is not totally occluded but a small residual air flow through the passageway is maintained.

Fuel is fed either by gravity or by a pump from a fuel line 29 into a fuel inlet in the feed pipe 26. When the fuel is supplied under pump pressure, i.e. above float pressure, a system incorporating the carburettor functions as an injector system rather than as a simple carburettor. Injection of fuel into the air stream through the carburettor may be intermittent or continuous.

The term "carburettor" is used herein generically to embrace devices which introduce a fluid fuel into an air stream. In a case where fuel is supplied to the carburettor at substantially constant pressure, this pressure may be derived from a float chamber to which fuel is supplied by a low pressure pump, from a header tube or direct from a low pressure pump, where a return line which by-passes the pump is provided to convey surplus fuel back to a reservoir.

The valve member is provided with a plurality of openings arranged to direct jets of fuel into the air flowing through the passageway. There are two axially extending rows of openings 27 at the external surface of the valve member at opposite sides of the sleeve 18 and a number of openings 28 around the side faces 14, 15 of the valve member.

The sleeve 18 has four rows of apertures 40 therein, two of which, 40*a* communicate directly with the openings 27 and two of which 40*b* communicate with the openings 28 through drilled or moulded bores 30. The feed pipe 26 also has four rows of apertures 31 arranged to register respectively with the four rows of apertures in the sleeve. The arrangement is that on turning of the valve member, the number of apertures of each pair of rows brought into registration is varied and/or the degree of registration of the apertures is varied.

Figure 5:
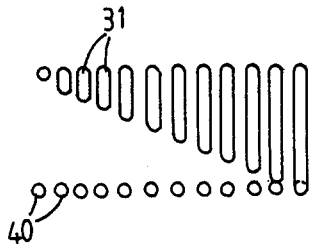
FIGS. 5, 6 and 7 show different arrangements of apertures in a fuel feed pipe and the valve member.

FIG. 5 shows an arrangement in which the apertures 40 in the sleeve of the valve member are small circular apertures disposed in a row parallel to the axis of the sleeve and the apertures 31 in the feed pipe are slots of progressively increasing length so that as the valve member is turned from its closed position towards its open position, more apertures come into register with one another.

Figure 6:
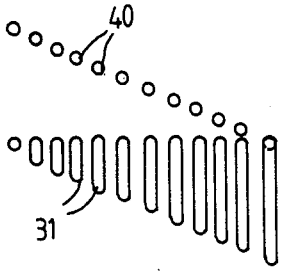

FIG. 6 shows a similar arrangement but with the apertures 40 at different angular positions.

Figure 7:
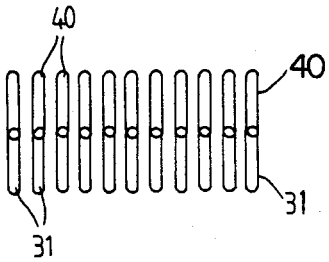

In FIG. 7 the rows of apertures 40 and 31 are both parallel to the common axis of the sleeve and feed pipe and the apertures are all in the form of identical slots whereby, on turning of the valve member from its closed position towards its open position, the degree of registration of each pair of corresponding slots increases.

Thus the rate at which fuel is introduced into the air flow varies according to the position of the valve member and hence the rate of flow of air through the passageway. As the air flows past the valve member its convex side faces produce a pressure drop which assists the flow of fuel out of the openings 27, 28 by providing a suction effect. Thus, a venturi effect is created in the zones A at opposite sides of the valve member.

Referring to FIG. 1, the sleeve 18 of the valve member 17 is mounted in seals 32 which prevent air/fuel mixture escaping from the passageway 11, and the feed pipe 26 has a threaded sleeve 33 which is engaged with a support 34 on the carburettor.

A needle adjustor 35 is located within the feed pipe 26, the needle having a threaded end 36 engaged in a screw-threaded bore in a support 37 on the carburettor whereby the needle is turnable for adjustment.

Figure 8:
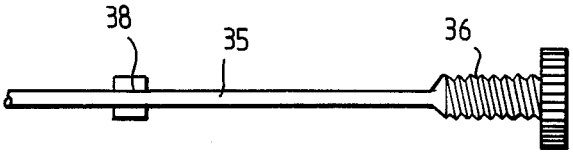
FIG. 8 is an enlarged view of a needle adjuster.

The needle adjustor is shown in detail in FIG. 8, the needle having a segmental shaped closure part 38 which can be moved around the interior of the fuel feed pipe 26 by turning the needle to open or close to a selected degree, a pilot hole drilled in the feed pipe 26 thereby to provide a pilot jet.

Although the valve member 17 has been described as being of double sided convex configuration, it will be appreciated that a valve member of any other suitable aerodynamic shape can be used. Further, for different engine requirements, the arrangement of apertures and/or the configuration of the valve member can be changed to provide the required air/fuel mixture over a range of valve member positions.

Figure 9:
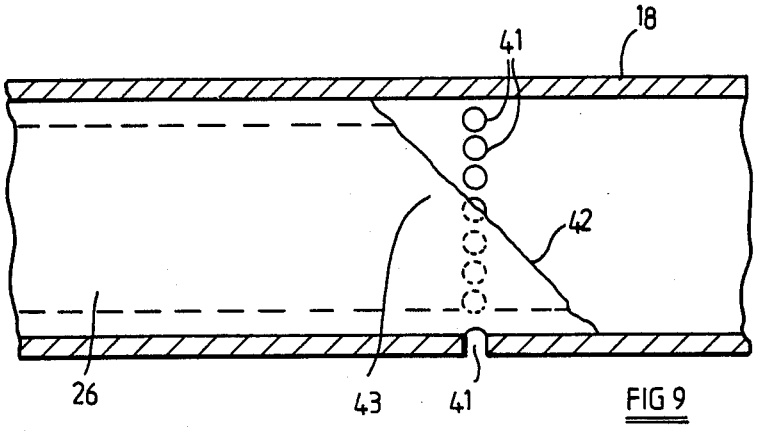
FIG. 9 shows a first modification of the carburettor.

For example, as shown in FIG. 9, the sleeve 18 of the valve member may be provided with a series of apertures 41 extending around approximately one half of the circumference of the sleeve and communicating with the openings in the valve member through which fuel is introduced into the air stream flowing through the tube 11 (which openings may have the same configuration as the openings 27, 28 or a different configuration), and the end 42 of the feed pipe 26 remote from the lever 25 may be formed with a single aperture 43 communicating through the bore of the pipe with the fuel inlet and may be of angled form so that on turning of the valve member, it closes a varying number of the apertures 41 and hence varies the amount of fuel delivered into the air stream according to the position of the valve member.

Figure 10:
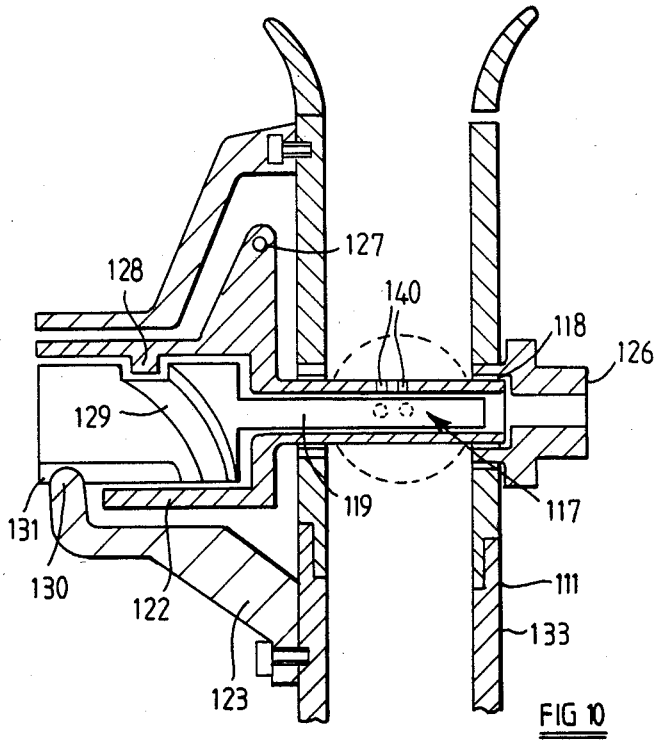
FIG. 10 is a view similar to FIG. 1 illustrating modifications of the carburettor of FIG. 1.
Figure 11:
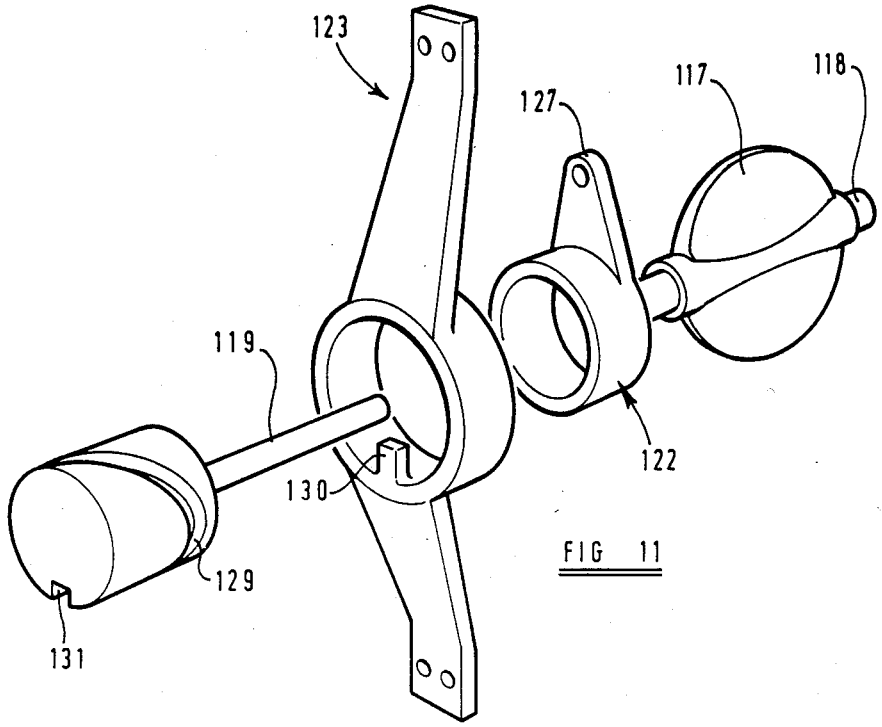
FIG. 11 shows isolated and in perspective view certain components shown in FIG. 10.
Figure 12:
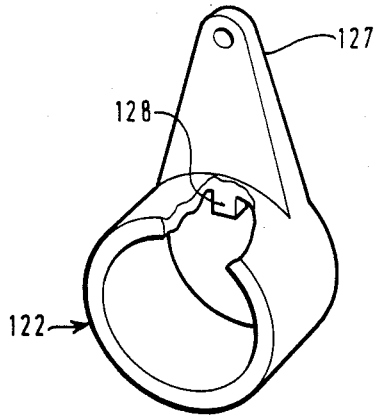
FIG. 12 shows a different perspective view of one of these components, the component being partly broken away.

The carburettor illustrated in FIGS. 10, 11 and 12 comprises a tube 111 which defines the air flow path and which may be identical with the tube 11 hereinbefore described. In the tube 111, there is disposed a valve member 117 in the form of a disc having convex faces. The disc is carried on a tube 118, opposite end portions of which protrude from the valve member into bearing openings in walls of the tube 11.

At one of its ends, the tube 118 communicates with a fuel feed pipe 126 corresponding to the fuel feed pipe 26 hereinbefore described. An end portion of the tube 118 is a sliding fit in an end portion of the fuel feed pipe, so that the tube 118 can rotate relative to the feed pipe but the joint between the tube and the fuel pipe is substantially fuel-tight. Towards its opposite end, the tube 118 is closed by an inner element in the form of a piston 119. The piston can slide along the tube to obscure apertures 140 provided in the sleeve and corresponding to the apertures 40 hereinbefore described.

The tube 118 is mounted in or is integral with a hollow housing 122 which lies outside the tube 111 and is supported by a bracket 123 for rotation about the axis of the tube 118, which is perpendicular to the axis of the tube 111. The bracket 123 is fixed on the outside of the tube 111. The housing includes an actuation lever 127 which, when the carburettor is in use, is connected with a control wire or control rod and by means of which the housing, the tube 118 and the valve member 117 can be turned together relative to the tube 111 through a range of 90°.

A dog 128 projects from the internal surface of the housing 122 into a cam slot 129 formed in the metering piston 119. This cam slot extends somewhat more than 90° around the axis of the metering piston and along the piston so that relative rotation of the housing and piston causes relative axial displacement. Rotation of the metering piston 119 with the housing 122 is prevented by a pin 130 on the bracket 123 which projects into an axially extending, rectilinear slot 131 formed in the external surface of the metering piston. The dog 130 permits axial sliding of the metering piston relative to the bracket but prevents rotation of the piston relative to the bracket. It will be noted that the portion of the metering piston in which the slots 129 and 131 are formed has a diameter several times that of the part of the metering piston which is disposed in the tube 118.

Different samples of carburettor can have cam slots 129 of respective different forms selected according to the required variation of fuel flow rate with air flow rate.

It will be understood that rotation of the valve member 117 in the tube 111 is necessarily accompanied by longitudinal movement of the metering piston 119 relative to the tube 118 and therefore adjustment of the number of apertures 140 which are open. The rate of flow of fuel through the valve member 117 into the tube 111 is adjusted automatically in accordance with the rate of flow of air through the tube 111.

As shown, the tube 111 may comprise two parts, 132 and 133, which cooperate with each other at a joint situated adjacent to the bearings for the tube 118. This joint may be a screwed joint.

A needle adjustor as hereinbefore described may be provided within the feed pipe 126.

In each embodiment of the invention herein described, the valve member may comprise a hollow, two-part body with at least some of the openings 27 and 28 being defined between the parts, or defined by respective jet elements mounted between the two body parts. In a case where the body of the valve member supports jet elements through which fuel is discharged into the air stream, the relation between the air flow rate and fuel flow rate through the carburetor can be varied by substituting for one or more jet elements alternative jet elements with openings of different size.

In a case where the valve member has a one-piece body provided with bores along which the fuel flows, jet elements may be screwed or otherwise fitted into counter bores at the outer ends of the bores.

Figure 13:
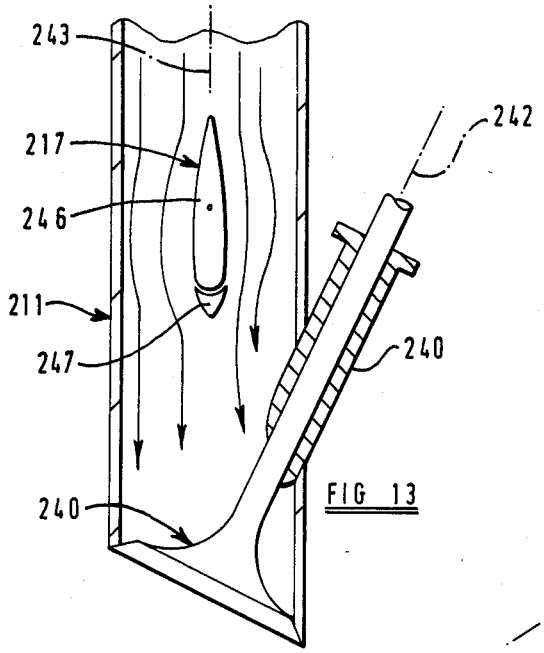
FIG. 13 illustrates diagrammatically a combination of a carburettor in accordance with the invention and a poppet valve.

In FIG. 13, there is illustrated a carburettor having a poppet valve 240 for controlling the flow of mixture of air and fuel through an outlet of the carburettor. The general arrangement and construction of the carburettor may be as hereinbefore described with reference to FIGS. 1 to 9 or as hereinbefore described with reference to FIGS. 10, 11 and 12. For convenience of illustration, only the tube 211 which defines the air inlet and the outlet of the carburettor and the valve member 217 are shown in FIG. 13. The poppet valve is guided by a valve guide 241 for reciprocation along a rectilinear path having a centreline 242 defined by the guide. The guide is fixed with respect to the tube 211 and protrudes into the interior of that tube at a position downstream of the valve member 217. Known valve gear (not shown) may be provided for operating the valve. It will be noted that the centreline 242 is inclined at an acute angle to a main axis 243 of the tube 211, which main axis extends through the centre of the air inlet to the carburettor and through the centre of the outlet from the carburettor.

Figure 15:
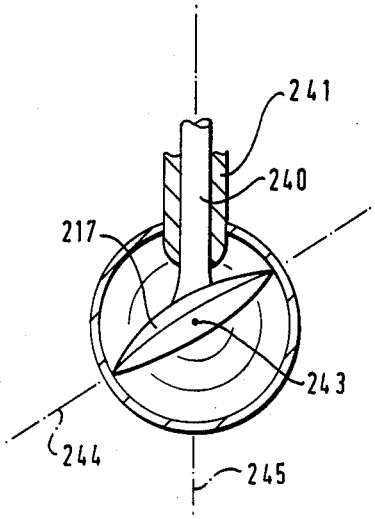
FIG. 15 is a view along a main axis of the carburettor of the parts shown in FIG. 13.

FIG. 15 is a plan view of the parts shown in FIG. 13. From FIG. 15, it can be seen that the plane 244 containing the main axis 243 and the axis about which the valve member 217 can pivot is inclined at an acute angle to the plane 245 containing the main axis 243 and the centreline 242 defined by the valve guide 241. This inclination improves the distribution of the flow through the outlet from the carburettor and may be as small as a few degrees or as large as 90°. The outlet may lead directly into the combustion chamber of an engine.

The valve member 217 comprises a main body 246 and a flap 247 at one edge of the main body. The main body and the flap together have a shape similar to that of the valve member 17. The structure of the main body is similar to that of the valve member 17. Thus, the main body 246 defines fuel-flow passages (not shown) leading from a central fuel pipe (not shown) to openings at the surface of the valve member. Demountable jet elements may be provided in these passages.

Figure 14:
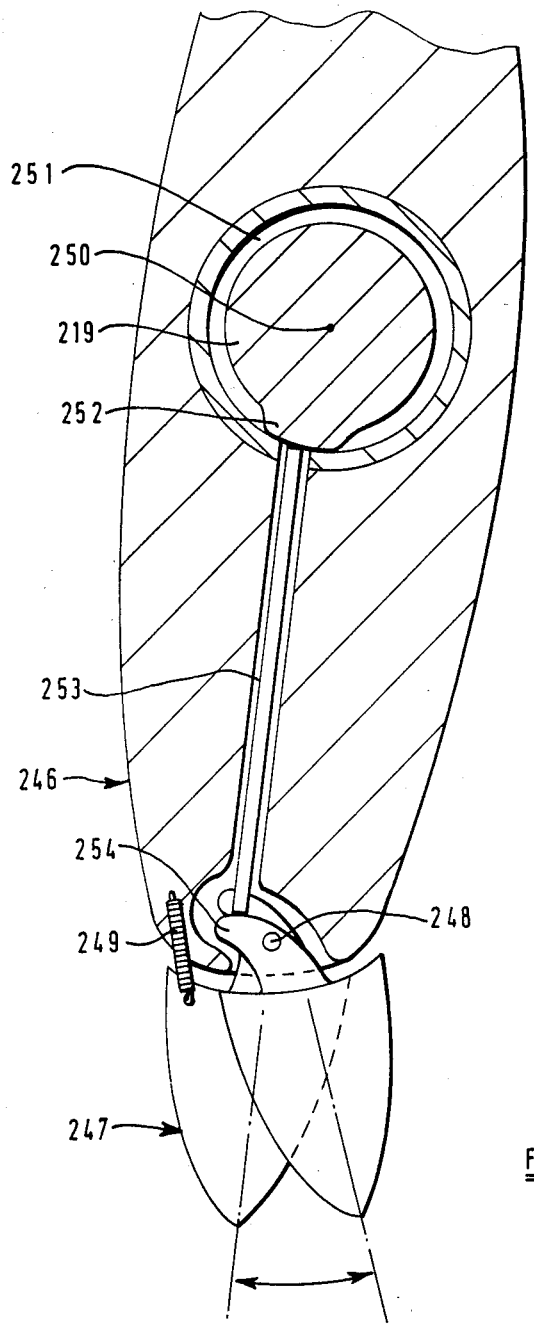
FIG. 14 is a cross-section of a part of a valve member of the combination shown in FIG. 13, the section being in a plane perpendicular to an axis of rotation of the valve member.

The flop 247 is connected with the main body 246 for angular movement relative thereto about an axis 248 which extends through the main body adjacent to the flap. As illustrated in FIG. 14, the flap can pivot from a position into which it is urged by a spring 249 and in which it is arranged symmetrically with the main body part 246, to a position in which it is offset towards one major face of the main body part.

Control means is provided for controlling pivoting of the flap 247 relative to the main body part 246 in accordance with pivoting of the main body part about the axis of the valve member. The valve member is provided with a metering piston 219 corresponding to the metering piston 119 hereinbefore described and illustrated in FIGS. 10 and 11. However, the metering piston 219 has at a position spaced axially from the fuel flow passages a circumferential recess 251 which extends a part of the way around the axis 250. Opposite ends of the recess are defined by a cam formation 252. The control means for the flap 247 includes a control rod 253 slidably mounted in a rectilinear passage formed in the main body part 246 and having one end which is disposed in the recess 251, when the valve member 217 occupies a closed position in the tube 211. An opposite end of the control rod lies adjacent to an operating lever 254 on the flap.

When the valve member 217 is pivoted about the axis 250 from its closed position to its fully open position, the control rod 253 is engaged by the cam formation 252 and driven out of the recess 251, towards the flap 247. This movement of the control rod is transmitted to the flap at the lever 254 to pivot the flap about the axis 248 against the action of the spring 249.

When the valve member 217 occupies its fully open position, the flap 247 is offset from the main body part 246 of the valve member somewhat towards the side of the tube 211 at which the valve guide 241 is disposed. The flap then deflects the mixture of fuel and air which flows towards the outlet of the tube 211 so that the flow is distributed more evenly around the periphery of the valve 240 than would be the case if the flap 247 were omitted.

Figure 16:
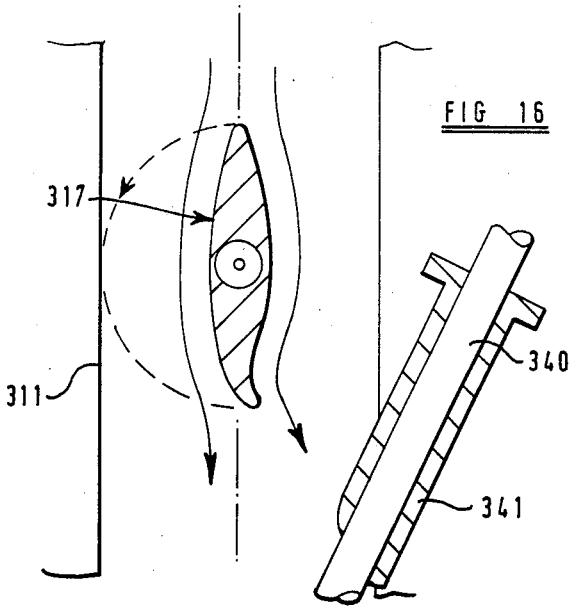
FIG. 16 is a view similar to FIG. 13 illustrating an alternative arrangement.

FIG. 16 illustrates an alternative to the pivoted flap 247 which achieves similar results. The valve member 317 shown in FIG. 16 may be substituted for the valve member 217 in the arrangement of FIG. 13. One marginal portion of the valve member 317 is offset relative to the remainder of the valve member somewhat in a direction which, when the valve member is in its fully open position, is towards that side of the tube 311 at which the valve guide is disposed. The profile of the valve member 317 is similar to that presented collectively by the main body portion 246 and flap 247 of the valve member 217, when the latter is in its fully open position. When the valve member 317 is partly open, the offset marginal portion has a lesser effect on the flow of air and fuel through the tube 311 than is the case when the valve member is in its fully open position.

The offset marginal portion of the valve member 317 may have a compound curvature. This valve member and both parts of the valve member 217 may be formed of polytetrafluorethylene.

The valve member is preferably mounted, as illustrated, for pivoting about an axis which intersects the main axis of the carburettor, that is an axis extending through the centre of the air inlet and through the centre of the outlet. Alternatively, the valve member may be mounted for movement about an axis which lies to one side of the main axis, for example an axis which is near to a tangent to an internal surface of the main tube of the carburettor. That tube may be formed with a recess at one side to accommodate a part of the valve member, when the valve member is in a fully open position. The sleeve of the valve member for containing the fuel feed tube would be disposed near to an edge of the valve member. The valve member would define passages similar to those hereinbefore described for leading fuel to openings at the surface of the valve member, from which the fuel is discharged into the air stream. The valve member also may be provided with a flap for modifying the flow of air. The main tube of the carburettor may be formed to define with the valve member, when in the fully open position, a venturi throat adjacent to the valve member.

It will be appreciated that a carburettor in accordance with the invention requires only one control line, in contra distinction to a conventional fuel injection system wherein a first control line is required for controlling a butterfly or other air valve and a second control line is required for controlling a fuel nozzle.

I claim:

1. In a carburettor having means defining an air inlet, a fuel inlet and an outlet for the mixture of fuel and air and having a movable valve member for regulating the flow of air from the air inlet to the outlet, the improvement wherein the valve member comprises relatively movable parts which collectively define an external surface of the valve member whereby the external shape of the valve member can be varied by relative movement of said parts and wherein the valve member comprises a main body, a flap mounted for limited movement relative to the main body and means for adjusting the angular relation of the flap to the main body in accordance with movement of the valve member as a whole relative to said means defining the outlet and wherein said main body defines an opening which is in communication with the fuel inlet for discharging fuel into the air stream which flows past the valve member in use.

2. The combination comprising a carburettor having means defining an air inlet, a fuel inlet and an outlet for a mixture of fuel and air, a main axis extending through the air inlet and through the outlet and having a valve member mounted for turning about a further axis transverse to the main axis for regulating the flow of air from the air inlet to the outlet, the valve member defining at least one opening which is in communication with the fuel inlet for discharging fuel into an airstream which flows past the valve member in use, a poppet valve for controlling flow of mixture from the carburettor through said outlet and means for guiding the poppet valve for reciprocation along a rectilinear path inclined to said main axis and defining a longitudinal centreline of said path, wherein the plane containing the main axis and said further axis is inclined at an acute angle to the plane containing the main axis and said centreline.

* * * * *